US010549403B2

(12) United States Patent
Hoglund et al.

(10) Patent No.: US 10,549,403 B2
(45) Date of Patent: Feb. 4, 2020

(54) FLEXIBLE GRINDING PRODUCT WITH FLATTENED SURFACE AND METHOD FOR MANUFACTURING THE SAME

(75) Inventors: Goran Hoglund, Nykarleby (FI); Hans Hede, Vora (FI); Nicolas Schumacher, Jeppo (FI); Mats Sundell, Hirvlax (FI); Jan Gron, Vora (FI)

(73) Assignee: KWH Mirka AB, Jeppo (FI)

( * ) Notice: Subject to any disclaimer, the term of this patent is extended or adjusted under 35 U.S.C. 154(b) by 348 days.

(21) Appl. No.: 14/425,766

(22) PCT Filed: Sep. 5, 2012

(86) PCT No.: PCT/EP2012/067294
§ 371 (c)(1),
(2), (4) Date: Jun. 22, 2015

(87) PCT Pub. No.: WO2014/037034
PCT Pub. Date: Mar. 13, 2014

(65) Prior Publication Data

US 2015/0343605 A1 Dec. 3, 2015

(51) Int. Cl.
*B24D 11/02* (2006.01)
*B24D 11/04* (2006.01)
(Continued)

(52) U.S. Cl.
CPC ..... *B24D 11/005* (2013.01); *B24D 3/02* (2013.01); *B24D 3/28* (2013.01); *B24D 11/02* (2013.01);
(Continued)

(58) Field of Classification Search
CPC ..... B24D 11/02; B24D 11/005; B24D 11/00; B24D 11/001; B24D 18/00; B24D 11/04;
(Continued)

(56) References Cited

U.S. PATENT DOCUMENTS 1,561,727 A 11/1925 Kingman
2,740,239 A * 4/1956 Ball ..... B24D 11/005 451/536
(Continued)

FOREIGN PATENT DOCUMENTS

CA 2806123 A1 2/2012
CN 87106418 A 3/1988
(Continued)

OTHER PUBLICATIONS

Foreign Office Action dated May 9, 2016; 11 Pages.

*Primary Examiner* — Eileen P Morgan
(74) *Attorney, Agent, or Firm* — Lowe Graham Jones PLLC

(57) ABSTRACT

A method of manufacturing a flexible grinding product comprises the steps: a) preparing an open cloth of knitted or woven fabric; b) applying a coating to one surface of the cloth, wherein the coated surface of the cloth has one or more flat portions; c) applying a grinding agent to the coated surface of the cloth. Further, a flexible grinding product has an open cloth, wherein a surface of the cloth is provided with a coating such that the coated surface has one or more flat areas which are at least partially provided with a grinding agent.

22 Claims, 11 Drawing Sheets

(51) Int. Cl.
*B24D 3/02* (2006.01)
*B24D 18/00* (2006.01)
*B24D 11/00* (2006.01)
*B24D 3/28* (2006.01)

(52) U.S. Cl.
CPC ..... *B24D 11/04* (2013.01); *B24D 18/00* (2013.01); *B24D 18/0072* (2013.01)

(58) Field of Classification Search
CPC .. B24D 18/0027; B24D 18/0072; B24D 3/02; B24D 3/28
USPC ..... 451/526, 529, 533, 536, 539
See application file for complete search history.

(56) References Cited

U.S. PATENT DOCUMENTS 2,778,169 A * 1/1957 Ball ..... B24D 11/00 451/531
2,984,052 A * 5/1961 Mueller, Jr. ..... B24D 11/00 451/536
3,276,852 A 10/1966 Lemelson
4,227,350 A * 10/1980 Fitzer ..... B24D 11/005 51/294
4,282,011 A * 8/1981 Terpay ..... B24D 11/02 139/420 C
4,386,943 A * 6/1983 Gumbel ..... C08L 61/20 427/209
4,826,508 A 5/1989 Schwartz et al.
4,867,760 A * 9/1989 Yarbrough ..... B24D 11/02 51/298
4,874,478 A 10/1989 Ishak et al.
4,925,457 A * 5/1990 deKok ..... B24D 3/06 51/293
5,066,312 A 11/1991 Ishak et al.
5,131,924 A * 7/1992 Wiand ..... B24D 3/06 51/293
5,203,881 A * 4/1993 Wiand ..... B24D 3/06 51/293
5,578,343 A 11/1996 Gaeta et al.
5,674,122 A 10/1997 Krech
5,679,067 A * 10/1997 Johnson ..... A46B 3/005 451/527
5,681,612 A 10/1997 Benedict et al.
5,700,188 A 12/1997 Uhlmann et al.
5,975,988 A * 11/1999 Christianson ..... B24D 3/002 451/28
6,024,634 A 2/2000 Hoglund et al.
6,383,064 B1 * 5/2002 Eggert ..... B24D 3/06 451/526
6,613,113 B2 9/2003 Minick et al.
6,634,929 B1 * 10/2003 Visser ..... B24B 7/241 451/41
6,923,840 B2 8/2005 Schutz et al.
7,258,705 B2 8/2007 Woo et al.
7,285,146 B2 10/2007 Peterson
8,057,287 B2 11/2011 Chao et al.
8,206,202 B2 6/2012 Hoglund
8,216,030 B2 7/2012 Hoglund
9,950,408 B2 * 4/2018 Palushaj ..... B24D 11/00
2002/0019199 A1 * 2/2002 Goers ..... B24B 7/241 451/41
2003/0022604 A1 * 1/2003 Annen ..... B24D 3/26 451/59
2003/0121212 A1 * 7/2003 Minick ..... B24D 3/002 51/295
2003/0143938 A1 * 7/2003 Braunschweig ..... B24D 11/02 451/533
2003/0207659 A1 * 11/2003 Annen ..... B24D 3/26 451/526
2004/0018802 A1 1/2004 Welygan et al.
2004/0148866 A1 8/2004 Krupnick
2004/0235406 A1 11/2004 Duescher
2005/0020190 A1 1/2005 Schutz et al.
2005/0118939 A1 * 6/2005 Duescher ..... B24D 11/00 451/527
2005/0130568 A1 * 6/2005 Welygan ..... B24D 3/002 451/59
2006/0156634 A1 * 7/2006 Welygan ..... B24D 3/002 51/298
2006/0280908 A1 * 12/2006 Hoglund ..... B24D 11/005 428/143
2007/0037500 A1 * 2/2007 Minick ..... B24D 11/001 451/533
2007/0066186 A1 * 3/2007 Annen ..... B24D 3/32 451/41
2007/0243802 A1 * 10/2007 Petersen ..... B24D 15/04 451/514
2008/0155904 A1 * 7/2008 Peterson ..... B24B 1/00 51/308
2008/0160087 A1 7/2008 Peterson et al.
2008/0160879 A1 * 7/2008 Peterson ..... B24B 1/00 451/28
2009/0229188 A1 9/2009 Hoglund
2009/0277098 A1 * 11/2009 Spies ..... B24D 3/001 51/295
2010/0003904 A1 * 1/2010 Duescher ..... B24B 37/14 451/259
2010/0075578 A1 3/2010 Chou et al.
2010/0130113 A1 5/2010 Hoglund
2011/0159794 A1 * 6/2011 Chung-Fat ..... B24B 55/06 451/527
2012/0045977 A1 2/2012 Hoglund
2012/0094587 A1 4/2012 Hoglund
2012/0322352 A1 * 12/2012 Petersen ..... B24D 3/002 451/539
2015/0183090 A1 * 7/2015 Hsu ..... B24D 18/0072 451/532

FOREIGN PATENT DOCUMENTS

CN 1077722 A 10/1993
DE 20111245 U1 8/2001
EP 0451944 A2 10/1991
EP 0779851 B1 5/1998
EP 1733844 B1 4/2009
EP 1522386 B2 5/2011
EP 2390056 A2 11/2011
JP 50-11118 1/1975
JP 5474587 A 11/1977
JP 61-244468 10/1986
JP 05229071 A 3/1990
JP 63-283868 5/1990
JP 03117565 12/1991
JP 06-155314 6/1994
JP 2001-1272 1/2001
JP 3657612 B2 3/2005
JP 2006-159343 6/2006
JP 2006-289592 10/2006
JP 3953099 B2 5/2007
JP 2009-502541 1/2009
JP 2009-508701 3/2009
JP 2012-210683 11/2012
JP 3182351 2/2013
JP 2014-018869 A 2/2014
RU 2385799 C2 12/2007
RU 2006120377 A 12/2007
WO 2011087653 A1 7/2011
WO WO2011087653 7/2011
WO 2014037034 A1 3/2014

* cited by examiner

FLEXIBLE GRINDING PRODUCT WITH FLATTENED SURFACE AND METHOD FOR MANUFACTURING THE SAME

PRIORITY CLAIM

This invention claims priority from PCT Application Serial No. PCT/EP2012/067294 filed Sep. 5, 2012, which is hereby incorporated by reference.

TECHNICAL FIELD

The present invention relates to a method of manufacturing a flexible grinding product and a flexible grinding product produced by the method.

BACKGROUND

Conventional flexible grinding products have a layer of paper, plastic or fabric carrying abrasive particles such as aluminum oxide or silicon carbide. The grinding or abrasive particles are applied to one surface of the product utilizing a binding agent. The flexible grinding product is for instance suitable to be mounted onto a rotating or oscillating plate of a grinding machine.

One reason for deterioration of the grinding performance is due to blocking as abrasive dust tends to clog the grinding surface of the product.

An improvement of the durability of the grinding product by reducing the above clogging effect was achieved with a grinding product described in EP 0 779 851 A1. The grinding product comprises a cloth of woven or knitted fabric having projecting loops or thread parts. A grinding agent is applied as separate agglomerates to the surface of the grinding product. The expression "separate agglomerate" means that the grinding product does not comprise a continuous grinding or binding agent layer that would cover the surface of the cloth, but instead the grinding agent forms small point or line shaped accumulations. Thus the cloth has and maintains an open structure which allows to remove the grinding dust from the surface.

In the above-mentioned prior art, the grinding agent is applied onto the irregular surface of projecting threads or loops. This has the consequence that a non-uniform grinding result due to an irregular height-distribution of the grinding particles cannot be excluded, at least in critical applications. A very flexible impregnation and coating alleviates the surface failures but reduces the performance of the grinding product.

Further, it is difficult to calibrate the product using the back surface as a support in order to achieve a flattened or smooth grinding surface. This is particularly the case when the back surface of the cloth is irregular, possibly carrying threads or loops for attaching the grinding product to a grinding tool, and/or when the back surface is at least partly fixed by an impregnation.

SUMMARY OF THE INVENTION

An object of the invention is to provide a grinding product and a method for manufacturing the same with improved grinding performance and excellent durability.

The object is solved with a method according to claim 1 and a flexible grinding product having the features of claim 14. The dependent claims define preferred embodiments.

In a first step, an open cloth of knitted or woven fabric is prepared. Preferred fabrics forming the basis of the grinding product are defined in ISO 8388 and comprise weft-knitted jersey-based fabrics, weft-knitted double layer jersey-based fabrics, weft-knitted rib-based fabrics, weft-knitted purl-based fabrics, warp-knitted jersey-based fabrics, warp-knitted double layer jersey-based fabrics, warp-knitted rib-based fabrics, warp-knitted purl-based fabrics, combined warp- and weft-knitted jersey-based fabrics and others. Here, it is important that the cloth is a so-called "open cloth", i.e. the cloth contains open spaces or regions defined for instance by loops or meshes. The open structure of the cloth allows removing grinding dust from the surface of the grinding product. The grinding dust can, for instance, be removed via evacuation from the backside of the grinding product.

In a second step, a coating is applied to one surface of the cloth. In the following, the surface carrying the coating is called grinding surface or front surface. The application of the coating is such that the coated surface of the cloth has one or more flat areas. In other words, the irregular grinding surface of the cloth defined by more or less protruding loops or threads etc. is not maintained unprocessed. Instead, the height-distribution is modified by the coating and/or the process of applying the coating such that one or more flat or plane areas are generated. The resulting cloth has a flattened front surface. Preferably, the coating is a polymer.

In a third step, a grinding agent is applied to the coated surface of the cloth. If necessary, an adhesive agent is used for adhering the grinding agent to the grinding surface.

The flexible grinding product as prepared above contains a network of channels and/or openings defined by fully or partially coated threads of the cloth. Due to the above-defined coating, plane portions carrying grinding agent are achieved without considerably impairing the open structure of the product. Thus, even though the flexible grinding product according to the invention utilized an open cloth, well-controlled and uniform grinding results are achievable. Further, the open cloth provided with controlled and flattened surface portions allows for very precise coatings like low or controlled make coat levels, intricate formations deposition and different print coating methods. Moreover, a very flexible impregnation and coating with minimal tendency to surface failures with excellent performance of the grinding product is achieved.

Preferably, the above second step contains at least two sub-steps. In a first sub-step, the coating is applied to the grinding surface of the cloth. In a second sub-step, at least a part of the coated surface is flattened by pressing the grinding surface against a working surface of a smoothing element, such as a plate, belt, film or drum. Large quantities of the flexible grinding product can thus be manufactured in a highly productive manner. When pressing the grinding surface against the smoothing element, a curing-step of the coating can be performed at the same time as discussed in more detail further below. Applying the coating and flattening the grinding surface via a smoothing element can be performed simultaneously or subsequently. In other words, the order of the two sub-steps of the second step is not particularly restricted. For instance, the smoothing element may carry the coating and apply the coating when pressing the grinding surface of the product against the working surface of the plate or drum. All kinds of pressure-less and low pressure coating and printing methods, such as kiss roller, gravure roller and screen printing that do not fill the openings in the cloth can be used. It is as well possible to apply the coating beforehand, for instance via dipping the cloth into the coating or spraying the coating onto the grinding surface or printing the coating onto the surface.

When using a smoothing drum, large or even endless sheets of cloth can efficiently be treated.

Preferably, the working surface of the smoothing element is provided with a structural pattern, for instance made of grooves and/or dimples for producing a pattern of plateaus in the coated surface. Printing or engraving a well-defined three-dimensional pattern into the grinding surface can be performed with regard to the uncoated cloth, the coated cloth or by simultaneously coating the cloth. It is for instance possible to press the cloth against a working surface of an engraved roller to create an engraved surface structure having protruding flat plateaus. Sometimes it is desired to have a three dimensional structure of isolated islands of flat plateaus in order to achieve a desired grinding result. In this respect, not only the coating but also the grinding agent is applied preferably discontinuously, for example in the shape of separate small islands. Further, when introducing artificial depressions or grooves into the cloth, well-defined channels are generated for evacuation of the grinding dust. In this respect, preferably, the engraved pattern is a regular or periodic pattern of grooves or depressions.

It is preferable that the coating is applied or calendered in a soft or fluid state. The viscosity can for instance be increased with heat. In this case, the coating can easily be applied with a well-defined thickness. It is preferable that the coating does not fully penetrate the cloth. When applying a coating with a certain viscosity, it may become necessary to cure the coating. This is achieved preferably via UV-radiation or other radiation. In this case, flattening the grinding surface via a smoothing element and curing the coating or performing part of the curing process can be achieved simultaneously or almost simultaneously. It is for instance possible to press the surface of the cloth against the working surface of the smoothing element while irradiating UV-light from the opposite side. The beams penetrate the cloth and reach the coating at the interface between grinding product and drum or plate. Alternatively, cooling or heating the coating is as well possible, in case the coating includes a thermosetting or a thermoplastic material. Curing or forming via heat or cooling can efficiently be achieved via a heated or cooled drum provided behind or downstream the smoothing element. Also the heated or cooled drum may have a desired structural pattern in its surface as to be transferred to the grinding surface of the product.

After curing, the coated surface of the cloth is preferably provided with an adhesive agent in order to support application and adhesion of the grinding agent which is to be applied. In this respect, it is preferable to apply the grinding agent or grinding particles via a kiss drum or via some other pressure-less of low-pressure method. When applying the grinding agent, it is thus preferable not to degrade the flattened, patterned structure of the grinding surface. Preferably, only flattened areas or plateaus are provided with grinding particles. The level difference between the higher plateaus and the lower depressions allows for a selective coating of only the higher plateaus. The generated grooves or channels as well as the openings of the fabric shall not be clogged with grinding particles. Preferably, the grinding particles or grinding agent contain abrasive particles such as aluminum oxide or silicon carbide, also more special particles such as diamond, boron nitride and engineered grains can be used. The flattened surface of the cloth is not only superior in view of the grinding result but also in view of the actual process of applying the grinding particles. The structured surface has plane surface elements following the knitted or woven structure of the product. The product can be provided with grinding particles in a well-defined manner.

Preferably flattening the coated grinding surface of the cloth includes a step of sanding the surface. A sanding step may be applied to further define or to define in first place the flattened structure. Sanding the grinding surface is useful in view of adjusting the size of the flattened areas as well as whether and how the flattened islands or areas are connected with each other. Here, a belt sander can be used, a drum sander, an oscillating sanding beam, combinations thereof or one or more other suitable sanding units. There may be used a calibrating roller or flat pad nip or the cloth can be pressed against the sanding unit by the actual web tension and certain angle of enlacement. There may as well be used combinations thereof.

Preferably, the cloth of knitted or woven fabric is impregnated before applying the coating. The impregnation helps preparing the cloth for accepting the coating. The impregnation stabilizes the structure of the fabric. Preferably, the impregnation agent is a resin (or a different) with a filler and may be based on latex to give a desired flexibility and elasticity.

Preferably, the cloth is provided with projecting loops and/or threads situated on the surface opposite to the grinding surface, wherein the projecting loops and/or threads originate from the threads of the cloth and wherein the projecting loops and/or threads are substantially free of the coating. The projecting loops and/or threads may serve as fastening means for mounting and holding the grinding product to a grinding tool. The loops and/or threads may serve as one part of a hook-and-loop fastener. In a preferred alternative, the flexible grinding product is laminated with foam onto a respective surface of the tool and the foam may further be laminated with a velour on the opposite side for fastening. Preferably, the flexible grinding product is provided with a foam and/or a velour on the side which is intended to be fastened to a respective surface of a grinding tool.

Preferably, the coating is or includes a polymer. The coating may be based on standard Oligomer and monomer-based acrylic formulations, water-dilutable acrylates, dual cure formulations, as well as Polyurethane-dispersions or similar materials. Further, also UV-curable epoxides and vinylmonomers are suitable materials. However acrylic oligomer/monomer-based formulations are preferred.

In the following, a tool or machine for coating and flattening a flexible grinding product is described. The tool comprises a coating agent applying unit for applying a coating agent to the grinding surface of the cloth, a smoothing and pressing unit, wherein the smoothing and pressing unit has a smoothing drum and is constructed and arranged so that the grinding surface of the cloth is pressed against the smoothing roll for flattening at least portions of the grinding surface, and a curing unit for curing the coating. It is possible that the coating agent applying unit and the smoothing and pressing unit are realized in one single unit allowing for simultaneously applying the coating agent and flattening the cloth.

According to one embodiment, the tool further comprises a grinding agent applying unit for applying a grinding agent to the grinding surface of the cloth.

Preferably, the tool further comprises a radiation source for curing the coating agent. Preferably, the radiation source is positioned opposite to the smoothing drum such that the radiation penetrates the cloth and the coated cloth is smoothened and cured simultaneously.

Preferably, the radiation for curing the coating agent is ultraviolet radiation.

Preferably, the tool further comprises means for transporting the cloth from the coating agent applying unit to the smoothing and pressing unit, if applicable, and for transporting the layer of knitted fabric from the smoothing and pressing unit to the grinding agent applying unit, if applicable.

Further advantages and aspects of the present invention are provided in the following description of particular embodiments. The above and below described features may be taken alone but may as well be taken in combination as long as they do not contradict each other. The following description has to be taken in consideration of the enclosed figures. In the figures, similar features carry the same reference sign.

SHORT DESCRIPTION OF THE DRAWINGS

FIGS. 9 to 15 schematically illustrate tools and processes for coating and flattening a cloth of fabric.

Figure 16:
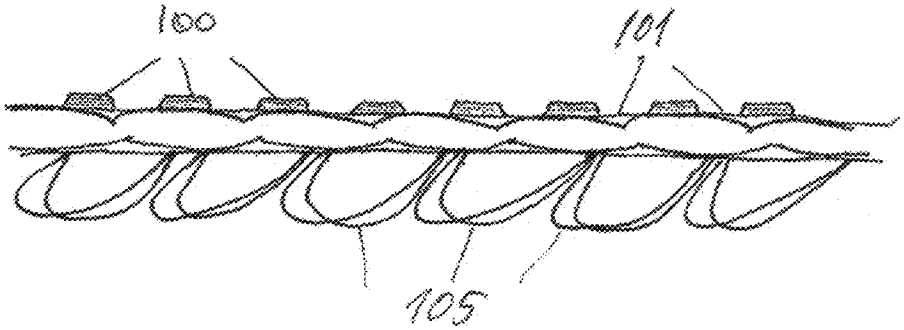

FIG. 16 shows a cross section of a grinding product including loops on the surface opposite to the grinding surface.

PREFERRED EMBODIMENT

Figure 1:
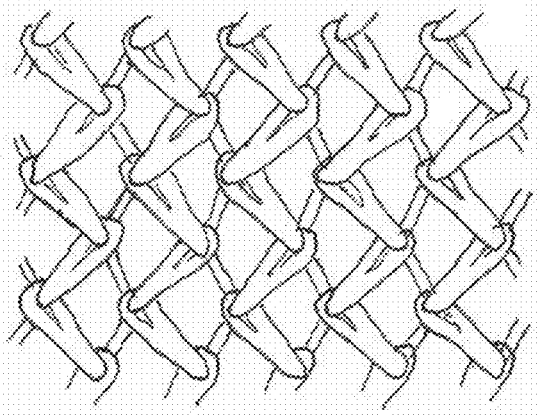
FIG. 1 is a plan view of a cloth of knitted fabric.

FIG. 1 is a plan view of a warp-knitted jersey according to ISO 8388 3.5.1. The fabric can be used as the basis for producing a flexible grinding product.

Figure 2:
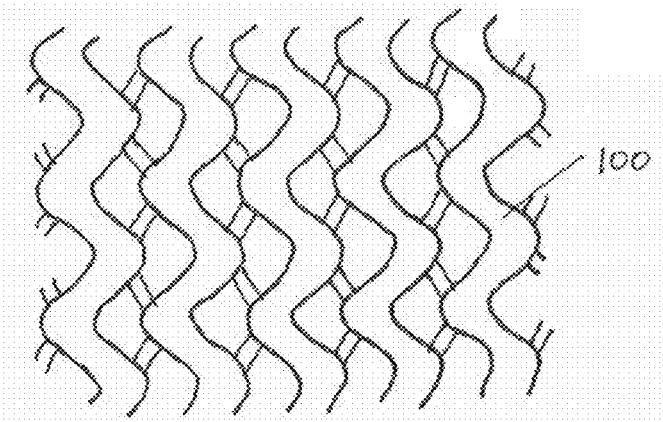
FIG. 2 is a plan view of the cloth according to FIG. 1, which has been coated and flattened.

The cloth is provided with a coating and it is flattened such that a sine-type plateau-structure 100 is generated as shown in FIG. 2.

Figure 9:
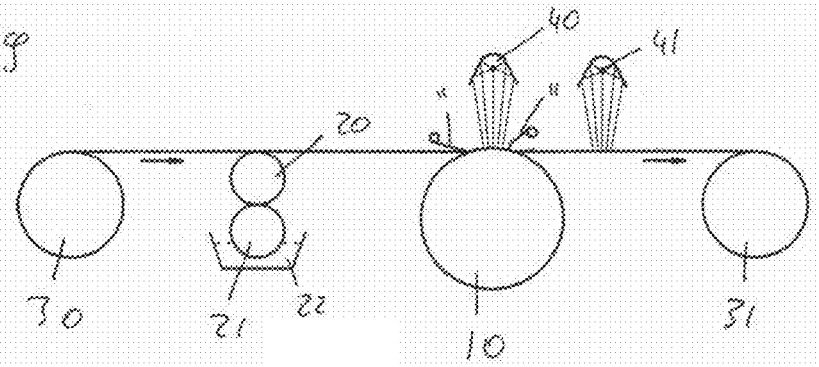
Figure 10:
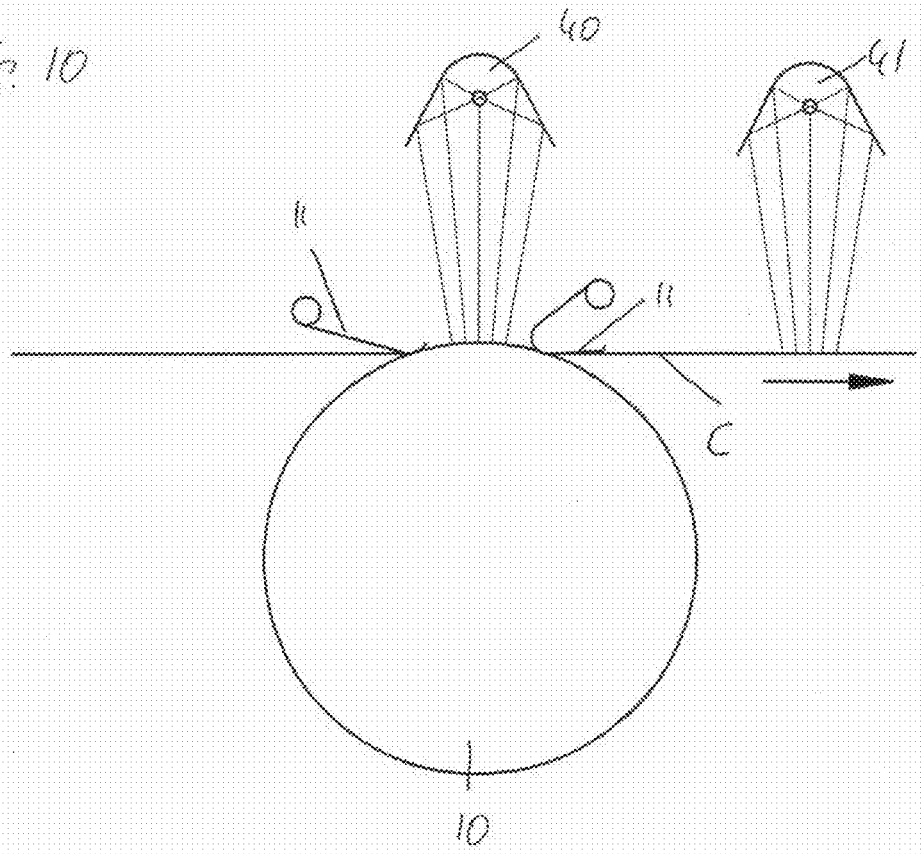

FIGS. 9 and 10 schematically illustrate a tool and process for applying a coating to the grinding surface of the cloth and for flattening the surface. FIG. 9 shows a processing line having a number of drums 10, 20, 21, 30, 31, some of them are optional, for transporting and processing a flexible grinding product and one or more UV-radiation sources 40. Drum 30 is for unwinding the pre-processed flexible grinding product, and drum 31 is for winding the prepared product.

Figure 3:
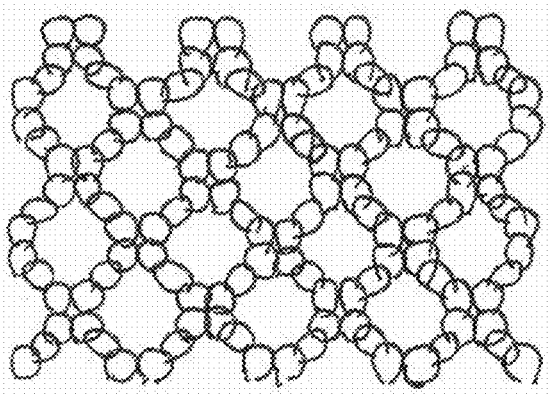
FIG. 3 is a plan view of a knitted fabric different to the fabric shown in FIG. 1.

Smoothing drum 10 is illustrated in FIG. 10 in more detail. The smoothing drum 10 is arranged such that it gets into contact with a piece or sheet of cloth C such as illustrated in FIGS. 1 and 3. Press plates 11 press the cloth C against a working surface of the smoothing drum 10. Application of the coating is for instance performed either via the smoothing drum 10 itself or, as illustrated in FIG. 9, via a coating drum 20 which is directly or indirectly in contact with a reservoir of coating agent 22. In FIG. 9, coating drum 20 is in contact with another drum 21 dipped into the reservoir coating agent 22. Transporting drums 30, 31 and/or other devices for transporting the sheet of cloth C are provided as required.

The smoothing drum 10 serves for flattening the coated cloth C. The result is a coated but still open cloth C having flat portions as for instance illustrated in FIGS. 2 and 4.

Thereafter or at the time of pressing the cloth C against the working surface of the smoothing drum 10, the coating is cured via UV-radiation originating from the UV-light source 40. Optionally, a second UV-light source 41 can be provided, or more, in case curing in more than one stages is required or desired. Depending on the coating agent, curing via heat or cooling is as well conceivable. It is as well possible to place one or more UV-light sources on the smoothed side of the cloth.

In order to achieve a zig-zag-pattern or sine-pattern as shown in FIG. 2, the smoothing drum 10 or optionally drum 20 or one or more additional drums may be provided with a structured pattern. The surface of the cloth is pressed against the working surface of the drum with a desired surface structure, thereby generating a regular or irregular structure of plateaus or islands of flat surfaces.

Alternative tools and processes for applying a coating to the grinding surface of the cloth and for flattening the surface are shown in FIGS. 11 to 15.

Figure 11:
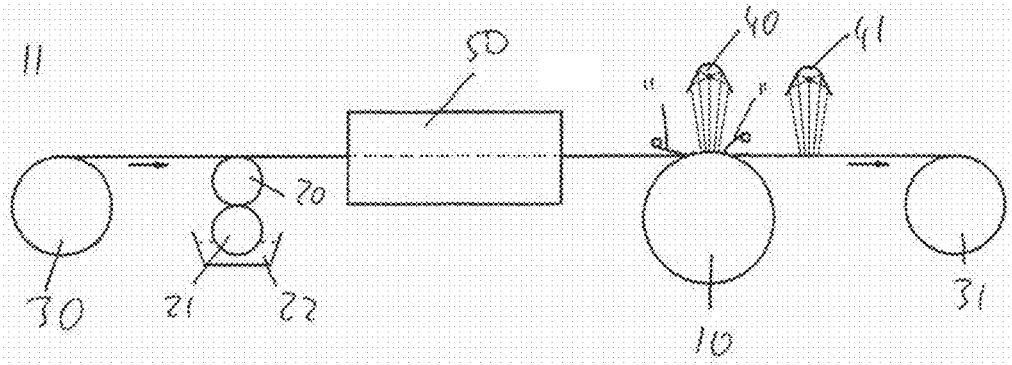

FIG. 11 shows a process with a drying- or pre cure unite 50 used for resins that are water- or solvent based. Alternatively, unite 50 may be an pre cure unite when the smoothing and resin need to be pre cured or thickened before the smoothing.

Figure 12:
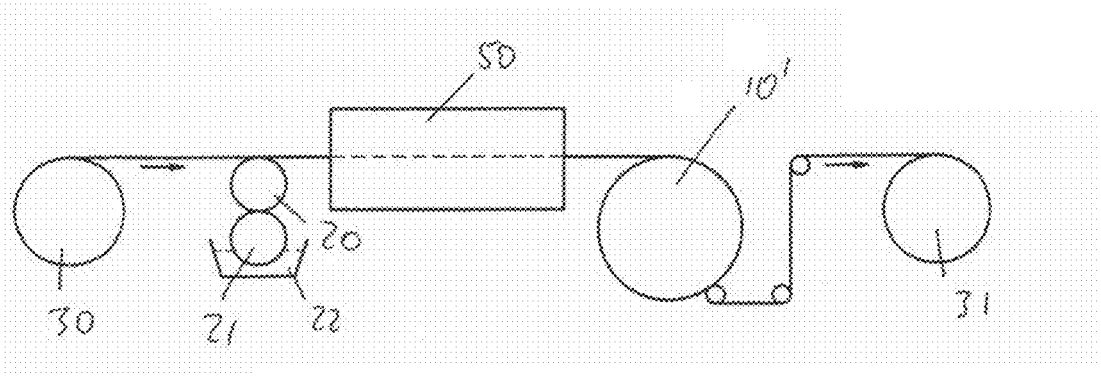

FIG. 12 shows a process where a heat set, water or solvent based resin is used for the smoothing. Drum 10' is heated and the coated cloth and its surface is heat set against the surface of the drum having the desired pattern or smoothness.

Figure 13:
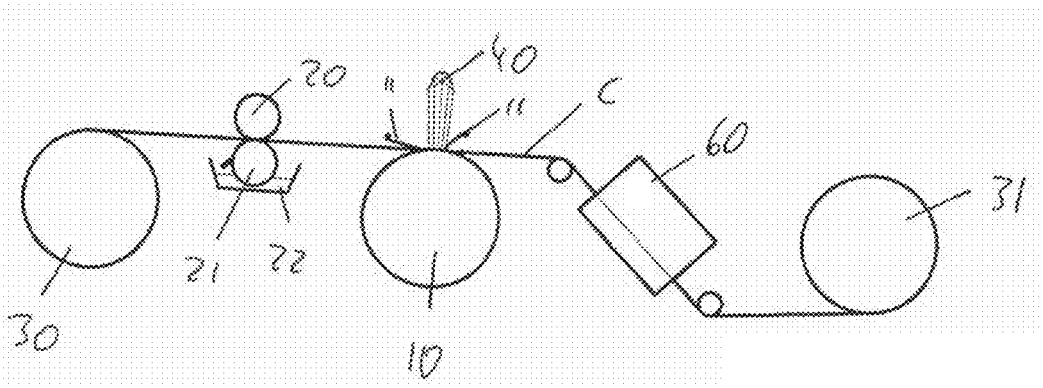

FIG. 13 shows a process including a curing unit 60 which is located between smoothing drum 10 and drum 31 for winding the flexible grinding product.

Figure 14:
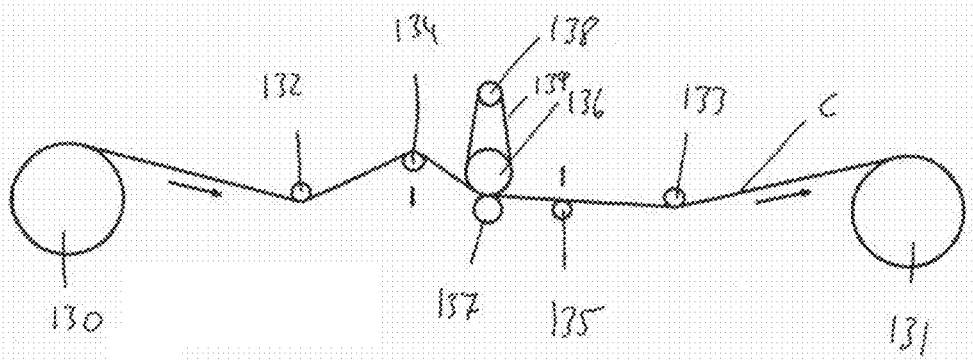

For simplicity, FIG. 14 illustrates a sub-process concentrating on an optional sanding process which can be included in one or more of the above described processes. Unwinding and winding rollers 130 and 131 are optional and may be omitted when incorporating the sanding process in one of the above described processes. Support rollers 132 to 135 serve for adjusting the flexible grinding product relative to the sanding unit which includes a sanding belt 139, an idle roller 138, a drive roller 136 and a pressure roller 137. For instance, two 134 and 135 of the support rollers may be movable as illustrated in order to adjust the angle of enlacement of the grinding product C. Other rollers may as well be movable, for instance for adjusting the enlacement pressure. As an example, the described grinding process may be included immediately after the curing unit illustrated in FIG. 13.

Figure 15:
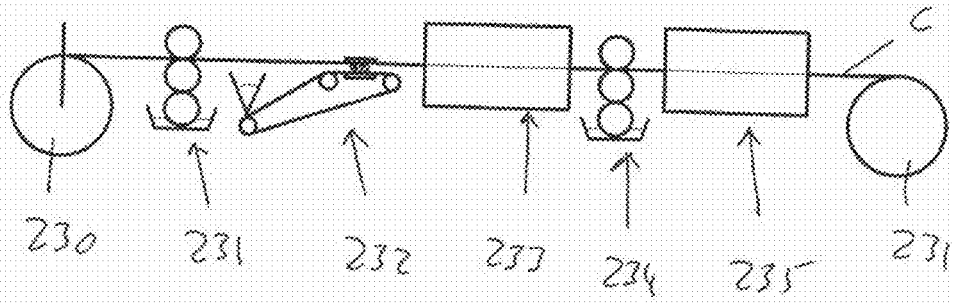

For simplicity, FIG. 15 illustrates a sub-process concentrating on a possible mineral coating process which may fully or partially be included in one or more of the above described processes. Unwinding and winding rollers 230 and 231 are optional and may be omitted when incorporating the mineral coating process in one of the above described processes. FIG. 15 schematically illustrates a kiss roller coating unit 131 for make coat, an electrostatic mineral coating unit 132, a first drying or curing chamber 233, another kiss roller coating unit 134 for size coat and a second drying or curing chamber 235.

Figure 4:
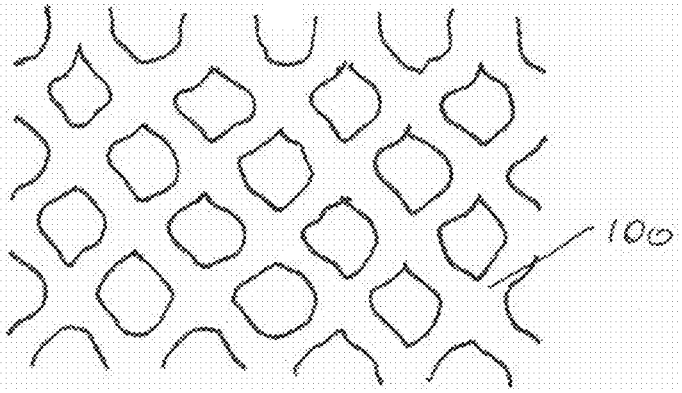
FIG. 4 is a plan view of the fabric shown in FIG. 3, which has been coated and flattened.

In another example, the basic cloth is based on a warp-knitted mesh fabric according to ISO 8388 3.5.46 as shown in FIG. 3. In FIG. 4, the open cloth is regularly flattened. The plateaus follow the shape of the filet openings of the cloth.

Figure 5A:
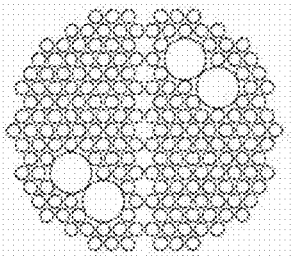
FIGS. 5A to 5H show cross sections of exemplary raw, coated and modified threads of a cloth.
Figure 5B:
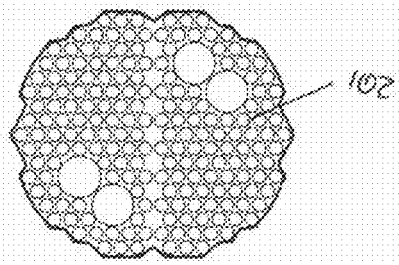
Figure 5C:
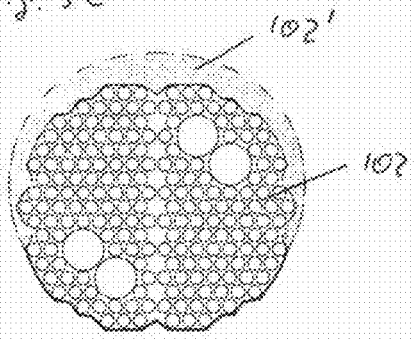
Figure 5D:
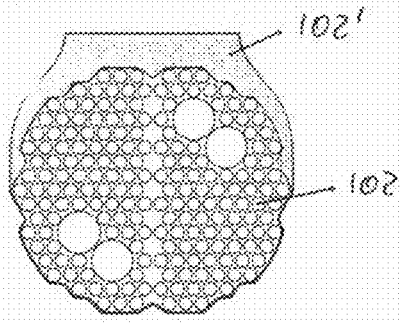
Figure 5E:
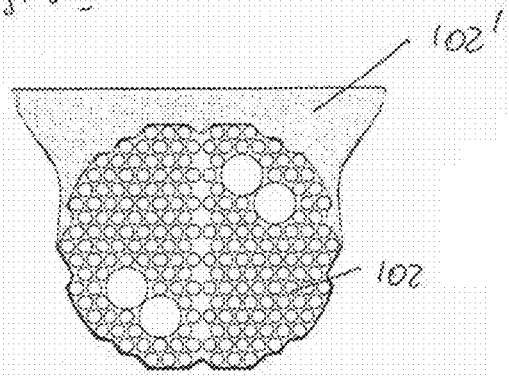
Figure 5F:
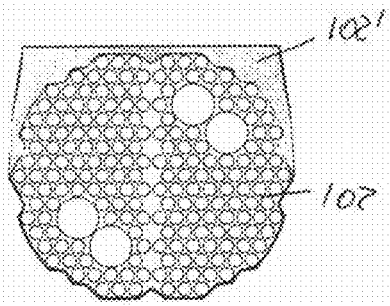
Figure 5G:
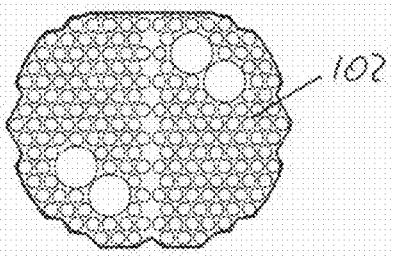
Figure 5H:
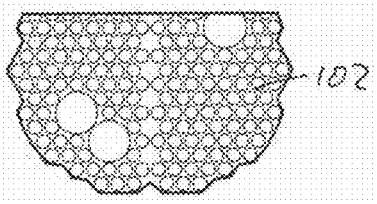

FIG. 5A shows a cross section of a loop bundle in a wale included in the cloth, such as a wale bundle or a double warp thread. In FIG. 5B, the thread is provided with a coating 102 partially or completely filling the thread. In FIG. 5C, the thread is filled and overcoated with coating agent 102, thereby supporting manipulation of the shape of the thread in view of generating flattened portions. Reference sign 102' denotes the overcoated portion of the coating 102. For example, the overcoated portions 102' are flattened or smoothed in FIGS. 5D, 5E and 5F. Wherein in FIG. 5D the flattened portion is narrowed, a flattened and broadened example is shown in FIG. 5E. A smoothed and sanded coated thread is shown in FIG. 5F. Overcoating of the thread is not necessarily required for flattening. Instead, the filled thread as shown in FIG. 5B may as well be flattened via a smoothing drum or sanded as shown in FIGS. 5G and 5H. The small and big circles in the illustrated loop bundles schematically indicate that it is possible to have fibers of different cross section. As an example, four monofilaments of larger cross section are included, which can be used to form projecting loops and/or threads situated on the surface opposite to the grinding surface. The projecting loops and/or threads may serve as fastening means for mounting and holding the grinding product to a grinding tool. The loops and/or threads may serve as one part of a hook-and-loop fastener.

An embodiment illustrating the above mentioned projecting loops is shown in FIG. 16. Here, the flexible grinding product has loops 105 on the surface opposite to the grinding surface carrying the coating 102 and the plateaus 100. The grinding product and a supporting surface of a grinding tool, which is not shown, are attached to each other by means of the loops 105 and corresponding means of the supporting surface, such as hooks. The loops and/or hooks provide for a distance between the grinding product and the supporting surface of the tool. Grinding dust which is first transported through the open areas/meshes of the cloth is, thus, easily removed from the grinding product via the open attachment structure utilizing loops 105. Alternatively or additionally, the flexible grinding product is laminated with foam and/or velour onto a respective surface of the tool, and, alternatively, the foam may further be laminated with a velour on the opposite side for fastening.

For sanding the product, a belt sander can be used, a drum sander, an oscillating sanding beam, combinations thereof or one or more other suitable sanding units. There may be used a calibrating roller or flat pad nip or the cloth can be pressed against the sanding unit by the actual web tension and certain angle of enlacement. There may as well be used combinations thereof.

Figure 6:
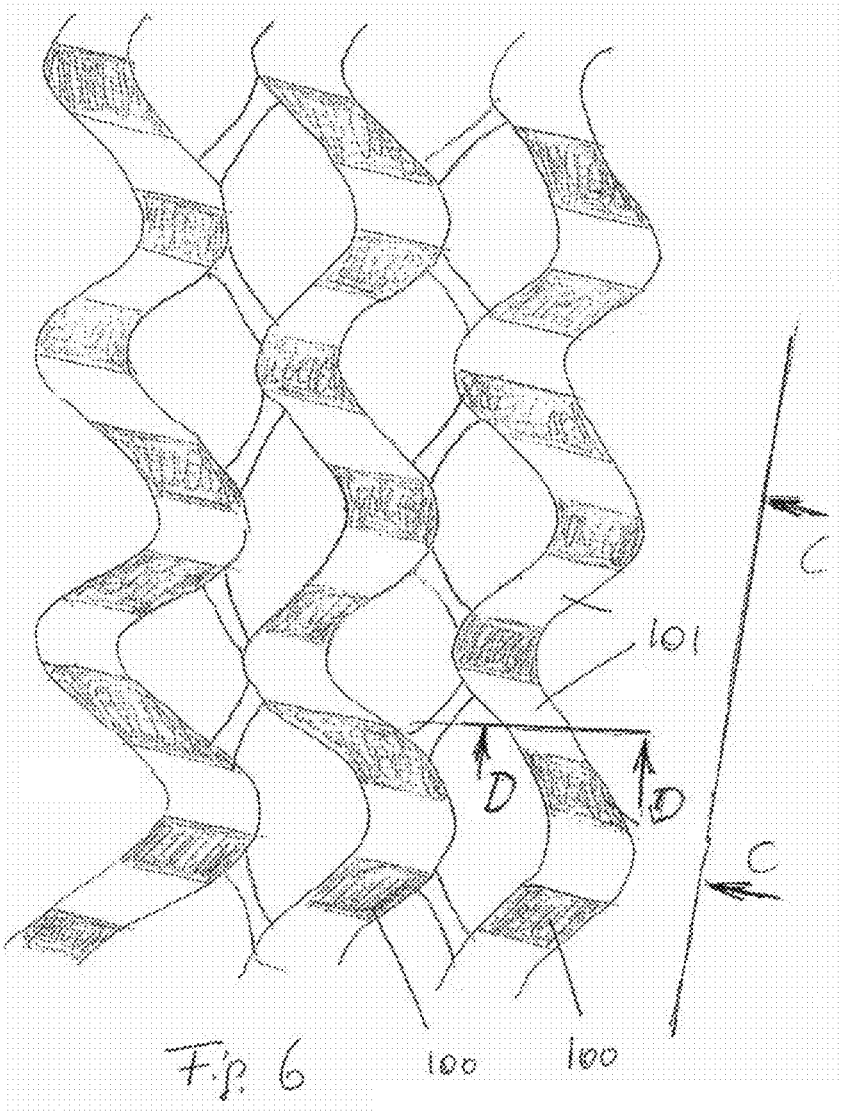
FIG. 6 is a plan view of an impregnated, coated and sanded cloth.

FIG. 6 is a plan view of a knitted fabric which was impregnated, overcoated, sanded and thereafter selectively provided with horizontal stripes of polymer, thereby a pattern of plateaus or protruding flat areas 100 was generated. These plateaus 100 are provided with grinding particles after curing the product such that wale-portions 101 remain free of grinding particles. Thus, islands of flattened portions carrying grinding particles are achieved. The grinding islands will naturally be arbitrarily or randomly positioned on the wales as the separation of the islands do not necessarily coincide with the pattern of the fabric. This effect can be enhanced by optimizing the pitch of the smoothing pattern in relation to the pattern of the cloth.

The pattern of plateaus can be achieved via different methods. For instance, the smoothing drum may carry a corresponding pattern, which then is transferred onto the surface of the fabric. Alternatively, after sanding or flattening the grinding surface of the cloth, the surface can be coated in an additional step with an engraved drum or roller, for instance with grooves in horizontal directions. As a third alternative, the illustrated plateaus 100 may as well be created with a screen-print-device. According to a fourth alternative, the coated, flattened and/or sanded surface of the cloth may be provided with an adhesive agent or make coat. The applied make coat may be structured via an engraved drum. Alternatively, a screen-print-device may be used for applying the make coat. Typically, the difference of level between the plateaus and the depressions when applying the fourth alternative is smaller than what is achievable via the first, second or third alternative because the amount of make coat is limited by abrasive coating demands.

The coating of the grinding particles can be made in different ways, the coating can comprise a separate make coat that bonds the separately coated grinding particles. The coating can alternatively comprise a slurry of bonding agent and grinding particles and this slurry can be coated into a layer as such, but the layer may subsequently be formed to sanding formations on the flattened surfaces in a desired pattern and shape of formations. The slurry may also be transferred by a roller, belt or film with the engraved desired pattern and may further be formed and cured while in contact with the transferring element.

Figure 7:
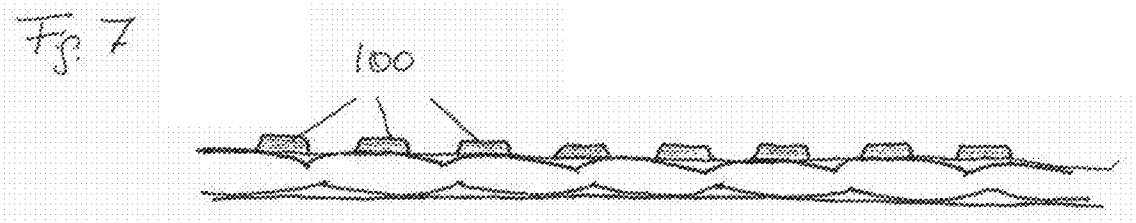
FIG. 7 shows the cross section through line C-C in FIG. 6.

A cross section through line C-C in FIG. 6 is shown in FIG. 7. Engraved stripes separating the plateaus 100 are cut roughly horizontally. A sloped cutting or other cuttings may as well be possible. Further, a zig-zag-shape or sine-shape as illustrated in FIG. 6 is not necessarily required. The shape of the flattened areas and/or the engraved pattern is adjustable in view of the used fabric, the intended grinding result or other requirements.

FIGS. 8A to 8D are cross sections including the plateaus 100 of FIGS. 6 and 7 as well as an underlying coated thread or wale part. The wale part is provided with a coating 102.

Figure 8A:
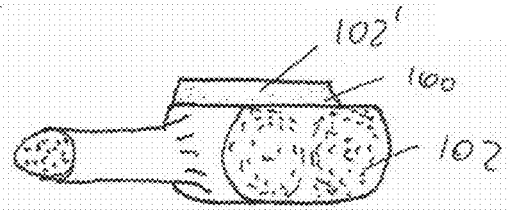
FIGS. 8A to 8D show cross sections through line D-D of FIG. 6.
Figure 8B:
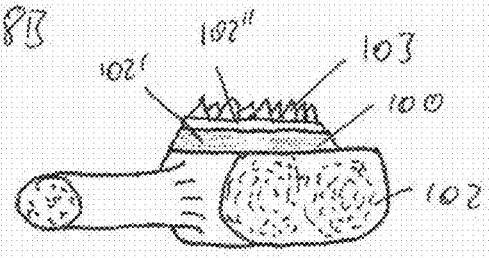
Figure 8C:
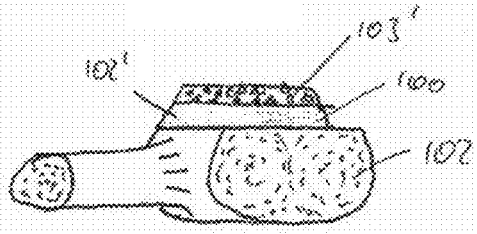
Figure 8D:
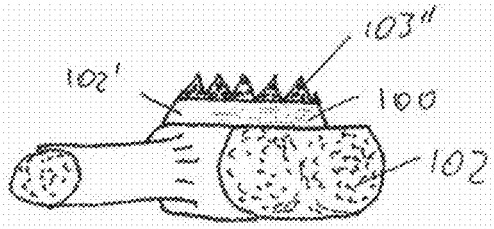

Overcoated portions 102' are flattened or smoothed. In FIG. 8B, plateau 100 is provided with an abrasive mineral serving as a grinding agent 103. Abrasive mineral 103 is applied utilizing an adhesive layer 102". In FIGS. 8C and 8D, the grinding agent 103' is a slurry deposited in even or structured formations on the flat portion 100.

Turning to the composition of the coating, polymers are preferred. The coating may be based on standard Oligomer and monomer-based acrylic formulations, water-dilutable acrylates, dual cure formulations, as well as Polyurethane-dispersions or similar materials. Further, also UV-curable epoxides and vinylmonomers are suitable materials. However acrylic oligomer/monomer-based formulations are preferred.

As an example, a formulation can consist of 20 wt % Bisphenol A Epoxy diacrylate, 5 wt % (1,6)-Hexanedioldiacrylate, 15 wt % Tricyclodecanedimethanol Diacrylate, 60 wt % Trimethylolpropane Triacrylate.

As alternatives also other combinations may be used which include other types of Epoxy acrylates, Polyester, Melamin, Polyurethane or Polyether acrylates.

To achieve suitable viscosity ranges some of the reactive thinners or monomers may as well partially be substituted by low viscous oligomer types such as aliphatic epoxy acrylates, e.g. CN152 from Sartomer.

Alternative monomers may include materials such as 2(2-ethoxyethoxy)ethyl acrylate, Isobornyl acrylate, Tetrahydrofurfuryl acrylate, 2-Phenoxyethyl acrylate, (1,6)-Hexanedioldiacrylate, Tripropylene glycol diacrylate, Dipropylene glycol diacrylate, Pentaerythritol Tetraacrylate, Di-Pentaerythritol Pentaacrylate, as well as other acrylate or methacrylate monomers. Suitable materials can also be for example other radically polymerizable vinylmonomers, like N-vinylcaprolactam.

The amount and type of filler that is used in the coating strongly influences on the final performance of the cured material. In order to modify the properties of the coating different kind of fillers can be used whereas also various combinations of filler materials may be applied. In case of UV-curable coating formulations one needs to assure that the filler is sufficiently penetrable for UV-light in order to ensure curing of the formulation. If, however, EB post-curing is applied during or after the coating step, the filler may also be impenetrable to UV-light. In this case UV-curing is applied in order to preliminary cure the material and fix surface shape and structure whereas the full mechanical properties are reached after EB-post-curing.

For fillers powders having small particle sizes below 10 μm are preferred. However coarser particles may be used as well, if applicable. Fillers may as well be used as blends in order to fine-tune the mechanical parameters of the coating. Examples for suitable fillers are Talc which is the preferred filler for this coating or Aluminumtrihydroxide as an example of an UV-penetrable filler material. Further on Kaolin, Calcium sulfate or fillers which are similar or identical to abrasive particles based on aluminumoxide, siliconcarbide and the like may be used. With increasing hardness of the filler material the coating will typically show a more brittle behavior towards tear and strain.

The initiator system used in the formulation is dependent on the resin system that is used. For a typical radically curing acrylic formulation mixtures of several initiators may be used, depending on the type of UV-lamp, line speed and if EB-postcuring is applied.

For a typical formulation with UV pre-curing and EB post-curing e.g. 5 wt % Benzophenone 1-hydroxy-cyclohexylphenyl-ketone mixture (Additol BCPK from Cytec) in combination with an amine acrylate (7 wt %) (Ebecryl 7100) or an amine synergist for instance a tertiary amine (Ebecryl P116) may be used. Other initiators and combinations e.g. MAPO, BAPO, thioxanthones and combinations thereof may be more suitable in some cases, for example when good through cure is required, typically in combination with only UV-curing hardening.

Other initiator types and combinations such as Iodonium-, Sulphonium and other derivates and e.g. anthracence-based derivates of sensitizers or the like may be applicable in case of acid-catalyzed hardening systems or if e.g. UV-LED curing is applied.

Blending of the resins requires no special attention except to assure that all components are homogenously blended within the mixture. Depending on the mixing equipment, the UV-resin may be blended first and the filler is added to the resin, though also the opposite order can be applied.

The choice of the type of monomer, oligomer and filler combination as well as their ratios strongly depend on the mechanical properties which are required or desired during the further process, e.g. as to the treatment the material such as winding or cutting. Mechanically, the coating needs to be capable of achieving sufficient tension and tear resistance as well as a sufficient flexibility for handling the material during the process.

In terms of applying the coating to a cloth, the UV-curing resin formulation with filler is blended as previously described. Initiators are required in case UV-curing is applied as a curing method.

According to one embodiment, it has shown to be practical to spread the resin/filler mixture by using a doctor roller on an even plastic film substrate, e.g. a PET film. Coating thickness of the resin blend hereby depends on the thickness of the cloth that shall be coated. Preferably coating thicknesses for the coating on the film substrate are between 50 and 800 μm, more preferably a thicknesses of approximately 300 μm is provided. Subsequently, the film which is coated with the uncured resin mixture is bent around a roller of suitable size and pressed against the cloth. The coated cloth is then moved under a UV-radiation source and cured, preferably from the backside of the cloth. It is possible to provide an even or calendered film with a surface pattern to be transferred into the grinding surface of the product.

The invention claimed is:

1. A method of manufacturing a flexible grinding product, the method comprising the following steps:

a) preparing an open cloth of knitted or woven fabric, the cloth having an open structure;

b) applying a coating to one surface of the cloth, wherein the coating is applied discontinuously in a shape of separated small islands, wherein the coated surface of the cloth has one or more flat plateaus, and the coated cloth maintains the open structure after applying the coating to facilitate removing grinding dust through the coated cloth during use of the grinding product;

c) applying a grinding agent to the coated surface of the cloth after step b), wherein step b) includes:

b1) applying the coating to one surface of the cloth;

b2) flattening the coated surface to produce the one or more flat plateaus before applying the grinding agent to the coated surface of the cloth in step c).

2. The method according to claim 1, wherein step b2) includes flattening the coated surface by pressing the surface against a working surface of a smoothing element.

3. The method according to claim 2, characterized in that the working surface of the smoothing element is provided with a structural pattern for producing a pattern of plateaus in the coated surface.

4. The method according to claim 1, characterized in that the coating is cured after step b), with UV-radiation or heat.

5. The method according to claim 1, characterized in that, step b) comprises sanding the coated surface to produce the one or more flat plateaus.

6. The method according to claim 1, characterized in that the cloth is impregnated between steps a) and b).

7. The method according to claim 1, characterized in that the cloth is provided with projecting loops and/or threads situated on an opposite surface of the surface to be coated, the loops and/or threads originating from threads of the cloth, wherein the coating is applied and cured such that the projecting loops and/or threads are substantially free of the coating.

8. The method according to claim 1, characterized in that the coating includes a polymer.

9. The method according to claim 2, characterized in that the smoothing element is a smoothing drum.

10. The method according to claim 1, characterized in that the grinding agent is a slurry deposited into sanding formations on the flat portions of the cloth.

11. The method according to claim 1, characterized in that the flexible grinding product is laminated with a foam onto a respective surface of a grinding tool.

12. The method according to claim 1, characterized in that the flexible grinding product is laminated with a velour onto a respective surface of a grinding tool.

13. A flexible grinding product made according to the method of claim 1, the flexible grinding product having an open cloth, wherein a surface of the cloth is provided with a coating such that the coated surface has one or more flat plateaus which have been obtained by flattening the coated surface and which are at least partially provided with a grinding agent after flattening the coated surface, the cloth having an open structure and maintaining the open structure after applying the coating.

14. The flexible grinding product according to claim 13, characterized in that the coated surface of the cloth has a pattern of grooves or an engraved structure including protruding flat plateaus.

15. The flexible grinding product according to claim 13, characterized in that the coated surface is sanded for producing the one or more flat plateaus.

16. The flexible grinding product according to claim 13, characterized in that the cloth is impregnated.

17. The flexible grinding product according to claim 13, characterized in that the cloth is provided with projecting loops and/or threads situated on an opposite surface of the surface to be coated, the projecting loops and/or threads originating from threads of the cloth, wherein the projecting loops and/or threads are substantially free of the coating.

18. The flexible grinding product according to claim 13, characterized in that the grinding agent is a slurry that is deposited as sanding formations on the flattened surfaces of the cloth.

19. The flexible grinding product according to claim 13, characterized in that the flexible grinding product is laminated with a foam onto a respective surface of a grinding tool.

20. The flexible grinding product according to claim 13, characterized in that the flexible grinding product is laminated with a velour onto a respective surface of a grinding tool.

21. A method of manufacturing a flexible grinding product, the method comprising the following steps:

a) preparing an open cloth of knitted or woven fabric, the cloth having an open structure;

b) applying a coating to one surface of the cloth, wherein the coated surface of the cloth has one or more flat plateaus, wherein 1) the coating is applied to the one surface of the cloth, the coated cloth maintaining the open structure after applying the coating, the coating being applied discontinuously in shapes of separated small islands; and 2) the coated surface is flattened by pressing the surface against a working surface of a smoothing element to produce the one or more flat plateaus, the working surface of the smoothing element having a structural pattern for producing a pattern of plateaus in the coated surface; and c) applying a grinding agent to the coated surface of the cloth after flattening the coated surface.

22. A method of manufacturing a flexible grinding product, the method comprising the following steps:

a) preparing an open cloth of knitted or woven fabric, the clothing having an open structure;

b) applying a coating to one surface of the cloth, wherein the coated surface of the cloth has one or more flat plateaus, wherein 1) the coating is applied to the one surface of the cloth, the coated cloth maintaining the open structure after applying the coating, the coating being applied discontinuously in shapes of separated small islands; and 2) the coated surface is sanded for producing the one or more flat plateaus; and c) applying a grinding agent to the coated surface of the cloth after producing the one or more flat plateaus.

* * * * *